US007419553B2

(12) United States Patent
Liedtke et al.

(10) Patent No.: US 7,419,553 B2
(45) Date of Patent: Sep. 2, 2008

(54) FUEL INJECTION VALVE FOR INTERNAL COMBUSTION ENGINES AND A METHOD FOR HARDENING THE SAID VALVE

(75) Inventors: Dieter Liedtke, Ludwigsburg (DE); Alfred Hoch, Ebelsbach (DE); Franz Wolf, Bamberg (DE)

(73) Assignee: Robert Bosch GmbH, Stuttgart (DE)

( * ) Notice: Subject to any disclaimer, the term of this patent is extended or adjusted under 35 U.S.C. 154(b) by 523 days.

(21) Appl. No.: 10/398,899

(22) PCT Filed: Jun. 19, 2002

(86) PCT No.: PCT/DE02/02239

§ 371 (c)(1),
(2), (4) Date: Sep. 15, 2003

(87) PCT Pub. No.: WO03/016708

PCT Pub. Date: Feb. 27, 2003

(65) Prior Publication Data

US 2004/0050456 A1 Mar. 18, 2004

(51) Int. Cl.
*C21D 9/00* (2006.01)
*C22C 38/22* (2006.01)

(52) U.S. Cl. ..... 148/319; 148/235; 148/233

(58) Field of Classification Search ..... 148/319, 148/225, 233, 235
See application file for complete search history.

(56) References Cited

U.S. PATENT DOCUMENTS 3,385,739 A * 5/1968 Danis ..... 148/226
4,035,204 A * 7/1977 Hack et al. ..... 148/210
4,201,600 A 5/1980 Luiten et al.
4,334,552 A 6/1982 Blanchard
4,801,095 A 1/1989 Banzhaf et al.
5,199,659 A * 4/1993 Zibilich, Jr. ..... 242/470
5,351,398 A * 10/1994 Haxell ..... 29/890.142
5,447,800 A 9/1995 Dorsch et al.
5,702,540 A * 12/1997 Kubota ..... 148/223
6,053,722 A 4/2000 Topolski et al.
6,526,949 B2 * 3/2003 Murakami et al. ..... 123/506

FOREIGN PATENT DOCUMENTS

DE 28 51 983 A1 6/1980
DE 35 36 452 A1 2/1987
EP 0 512 254 A2 11/1992

(Continued)

OTHER PUBLICATIONS

English abstract of Japanese patent 401212748 dated Aug. 25, 1989, Kimura, Toshimitsu et al.*

(Continued)

*Primary Examiner*—Deborah Yee
(74) *Attorney, Agent, or Firm*—Ronald E. Greigg

(57) ABSTRACT

A fuel injection valve for internal combustion engines, having a valve body and at least one injection opening embodied in it, through which opening, controlled by a valve needle that cooperates with a valve seat embodied in the valve body, fuel can be injected into the combustion chamber of the engine. The valve body comprises a high-alloy hot-work steel, which has been hardened by a case-hardening process.

6 Claims, 1 Drawing Sheet

FOREIGN PATENT DOCUMENTS

| | | | | |
|---|---|---|---|---|
| EP | 0 982 493 | A1 | | 3/2000 |
| GB | 2 040 318 | A | | 8/1980 |
| JP | 54-125148 | | * | 9/1979 |
| JP | 62-17364 | | | 1/1987 |

OTHER PUBLICATIONS

George E. Dieter, Mechanical Metallurgy, second edition, 1961, pp. 471-472.*
J.G Henderson, Metallurgical Dictionary, 1953, p. 173.*

* cited by examiner

FUEL INJECTION VALVE FOR INTERNAL COMBUSTION ENGINES AND A METHOD FOR HARDENING THE SAID VALVE

CROSS-REFERENCE TO RELATED APPLICATIONS

This application is a 35 USC 371 application of PCT/DE 02/02239 filed on Jun. 19, 2002.

BACKGROUND OF THE INVENTION

1. Field of the Invention

This invention relates to an improved fuel injection valve and to a method of producing the valve.

2. Description of the Prior Art

From the prior art, various methods for hardening steel are known. The intent is to vary the wear resistance and durability of the material as well as its workability. One example is known as case-hardening or carburization, in which carbon is incorporated into the layers near the surface of the workpiece. One method in this respect is described in U.S. Pat. No. 4,836,864, for instance. Other possibilities are nitriding of steels, in which nitrogen is incorporated into the layers near the surface of the workpiece. In fuel injection valves as well, of the kind used preferably for self-igniting internal combustion engines and described for instance in German Patent Disclosure DE 196 18 650 A1, the use of such hardened and treated steels for lengthening the service life of the steels is also known. In the course of further development in engines, the temperature stress on the fuel injection valve and thus on the needle seat in the valve body will continue to increase because of an increase in performance or an enhancement in the braking power, especially in utility vehicles. The carburized steels used until now, and the hardening methods employed for them, are no longer sufficient for these applications.

SUMMARY OF THE INVENTION

The fuel injection valve for internal combustion engines according to the invention has the advantage over the prior art that the valve body is shape-and wear-resistant up to high temperatures and is thus suited for use at all operating points of an internal combustion engine. The valve body of the fuel injection valve comprises a high-alloy hot-work steel that has been hardened by a case-hardening or carburization process. Combining the high-alloy hot-work steel with a suitable carburization process favorably combines the advantages of both the material and the hardening process. A marked increase in the vibration strength of the high-alloy steel from a reduced notch effect in use, a reduction in erosion in the ensuing grinding machining at the function geometries, and a reduction in the necessary initial hardness of the valve body and hence improved machinability, as well as a reduction in the vulnerability to cavitation in the valve body, particularly in the region of the valve seat, are obtained.

In an advantageous feature of the subject of the invention, the hot-work steel is shape- and wear-resistant up to a temperature of 450° C. As a result, the fuel injection valve is suitable for use at all possible operating points of the internal combustion engine.

In an advantageous feature of the invention, the high-alloy hot-work steel contains at least approximately 0.4% carbon, 5% chromium, 1% molybdenum, and trace amounts of other metal and nonmetal elements adding up to a total of less than 1%, and the remaining proportion to make up 100% is iron.

Such steels, such as X 40 CrMoV 51, are available on the market and can be used without further effort or expense.

In a further advantageous feature, the carburization process is a gas carburization process. As a result of the carburization, an otherwise necessary complicated postmachining operation becomes unnecessary.

The method according to the invention for hardening a valve body that is part of a fuel injection valve for internal combustion engines has the advantage that as a result of the treatment, the valve body has the requisite thermal strength for use in the combustion chamber of an internal combustion engine. To that end, the valve body is carburized in a gas atmosphere that contains a hydrocarbon and is then heat-treated at a temperature of approximately 900° C. in a vacuum, or at most at a pressure of 100 Pa. By the combination of these two method steps with a high-alloy hot-work steel, optimal hardening and wear resistance of the high-alloy hot-work steel can be achieved, so that this steel remains usable even at temperatures of the kind that occur under extreme loads in the combustion chamber of a self-igniting internal combustion engine.

In an advantageous feature of the method, the carburization takes place at a pressure of less than 100 kPa. Because of this negative-pressure carburization process, a lessening in the formation of peripheral oxidations, which reduce strength, is obtained in particular.

BRIEF DESCRIPTION OF THE DRAWING

Other features and advantages of the invention will become apparent from the detailed description contained herein below, taken in conjunction with the single drawing FIGURE showing a fuel injection valve in longitudinal section as an example of a hardened valve body.

DESCRIPTION OF THE PREFERRED EMBODIMENT

Figure 1:
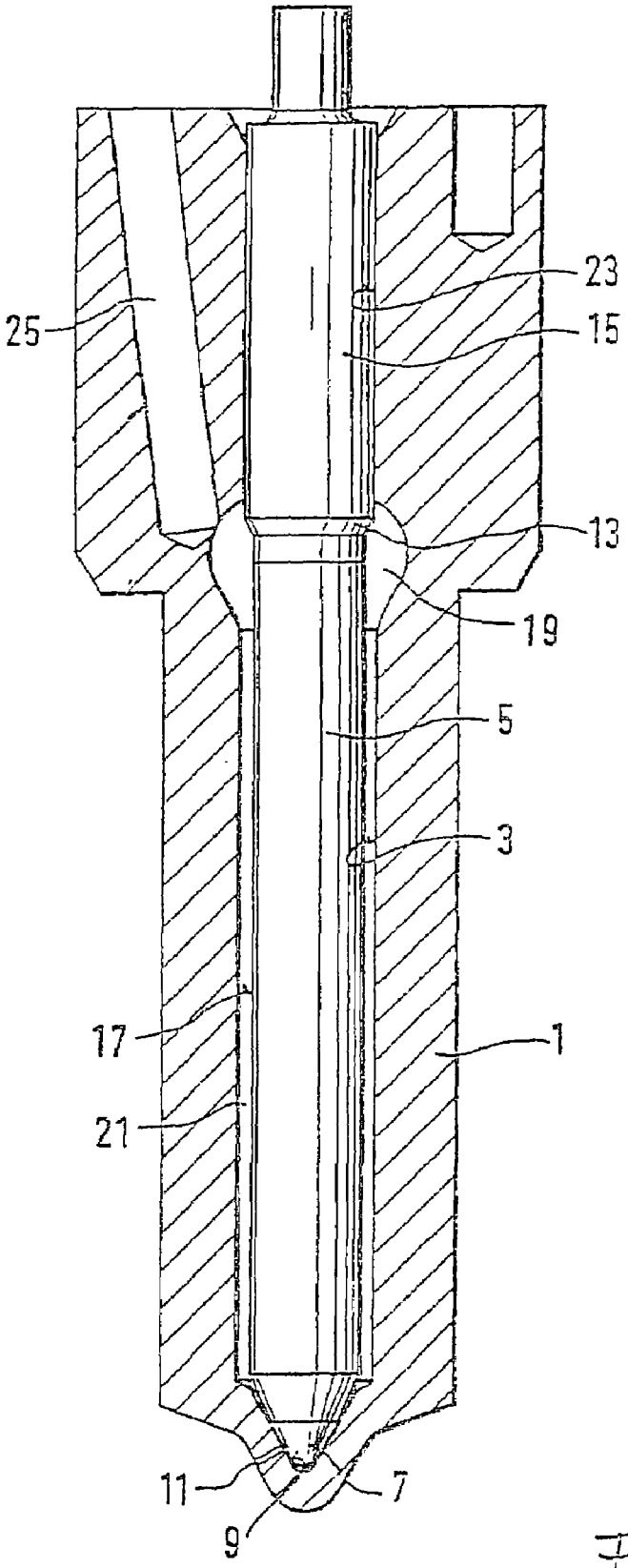

The fuel injection valve shown in FIG. 1 has a valve body 1, in which a valve needle 5 is disposed longitudinally displaceably in a bore 3. A substantially conical valve seat 9 is embodied on the end of the bore 3 toward the combustion chamber, and at least one injection opening 11 is embodied in the valve seat and connects the bore 3 with the combustion chamber of the engine. The valve needle 5 has a guide portion 15, with which it is sealingly guided in a guiding portion 23 of the bore 3. In the direction of the valve seat 9, the valve needle 5 narrows, forming a pressure shoulder 13, and changes over into a shaft portion 17 of reduced diameter. On the end of that portion, a substantially conical valve sealing face 7 is embodied which cooperates with the valve seat 9 and thus upon contact with the valve seat 9 closes the at least one injection opening 11 off from the bore 3.

At the level of the pressure shoulder 13, a pressure chamber 19 is embodied by a radial enlargement of the bore 3; it can be filled with fuel at high pressure via an inlet conduit 25. The pressure chamber 19 continues, toward the valve seat 9, in the form of an annular conduit 21, which surrounds the shaft portion 17 of the valve needle 5. In this way, the fuel flows out of the inlet conduit 25 through the pressure chamber 19 and the annular conduit 21 as far as the valve seat 9 and, if the valve sealing face 7 has lifted from the valve seat 9, through the injection openings 11 into the combustion chamber of the engine.

The valve needle 5 is controlled by the ratio of the hydraulic forces on the pressure shoulder 3 and the valve sealing face 7 on the one hand and a closing force on the other; this closing force acts on the end of the valve needle 5 remote from the combustion chamber and urges the valve needle 5 in the direction of the valve seat 9. One possible operating state of the fuel injection valve is that in which the closing force on the valve needle 5 remains constant, while the fuel pressure in the pressure chamber 19 and in the annular conduit 21 varies because of replenishing fuel from the inlet conduit 25. Because of the fuel pressure in the pressure chamber 19 and in the region of the valve seat 9, the valve needle 5 experiences a hydraulic force that is oriented away from the valve seat 9. If this hydraulic force is greater than the closing force on the valve needle 5, then the valve needle moves away from the valve seat 9 and thus lifts along with the valve sealing face 7 from the valve seat 9. If the pressure in the pressure chamber 19 falls below a certain threshold pressure, then the closing force on the valve needle 5 predominates, and the valve needle moves back in the direction of the valve seat 9, until the valve sealing face 7 closes the at least one injection opening 11 once again. 20

Because of the longitudinal motion of the valve needle 5 and the relatively hard impact of the valve needle 5 as it becomes seated on the valve seat 9, high forces on the valve body 1 are engendered in the region of the valve seat 9. Also because of the longitudinal motion of the valve needle 5 in the guiding portion 23 of the bore 3, there are friction losses between the valve needle 5 and the wall of the bore 3; if the material comprising the valve body 1 is soft, the result can be excessively high wear. To increase the hardness and thus the wear resistance, a so-called hot-work steel, which is among the tool steels, is used for the valve body 1. The use of high-alloy hot-work steels, such as the steel known as X 40 CrMoV 51, has proved to be especially advantageous. This high-alloy hot-work steel can be exposed to operating temperatures of up to 450° C. without losing hardness and hence wear resistance. However, if the requisite quality demands for fuel injection valves are to be met, the surface of the valve body 1 must be additionally hardened. To that end, carbon is incorporated into the layers near the surface of the valve body 1 in a so-called case-hardening or carburization process, as a result of which the surface becomes hardenable. One possible carburization process is the gas carburization process, in which the steel is exposed, at a temperature of 900° C. to 1000° C., to an atmosphere comprising hydrocarbons and chemically inert gases, such as nitrogen ($N_2$). In this process, the carbon diffuses into the layers near the surface of the valve body 1, so that the carbon content increases there. The hardening depths here amount to from 0.3 to 4 mm. As a result of the carburizing treatment, the material becomes hardenable, and this hardening is done by ensuing heating in a vacuum furnace. In that process, the workpiece, in this case the valve body 1, is heated to approximately 800° C., and a substantial vacuum, or in this case a pressure of less than 100 Pa, prevails in the hardening furnace.

The advantage of this method of hardening the valve body 1 is in the combination of a high-alloy hot-work steel with a gas carburization process that employs negative pressure, that is, a pressure of less than 100 kPa. As a result, the advantages of the hot-work steel are added together with those of the carburization and hardening method. A marked increase in the vibration strength of the high-alloy steel is obtained as a result of a reduced notch effect in the use of the negative pressure carburizing process, since peripheral oxidations are avoided. At the same time, a reduction in erosion in the ensuing grinding machining at the function geometries is obtained, since the injection opening 11 is postmachined by hydroerosive grinding.

Another advantage is the reduction in the necessary initial hardness of the fuel injection valve and thus improved machinability after the heat-treatment of the valve body 1. A reduction in the vulnerability to cavitation of the surfaces is also obtained, especially in the region of the inlet bore and needle seat of the valve body 1.

Besides the high-alloy hot-work steel X 40 CrMoV 51, still other high-alloy hot-work steels can also be used that have a carbon content of from 0.3 to 0.5%.

The foregoing relates to preferred exemplary embodiment of the invention, it being understood that other variants and embodiments are possible within the spirit and scope of the invention, the later being defined by the appended claims.

We claim:

1. A fuel injection valve for internal combustion engines, comprising a valve body (1) having at least one injection opening (11) embodied in it, a valve seat (9) embodied in the valve body (1), and a valve needle (5) that cooperates with the valve seat (9) to control fuel injection into the combustion chamber of the engine, the valve body (1) comprises a high-alloy hot-work steel which has been hardened by a carburization process.

2. The fuel injection valve of claim 1, wherein the hot-work steel is shape- and wear-resistant up to a temperature of 450° C.

3. The fuel injection valve of claim 2, wherein the hot-work steel contains the following elements in amounts of at least approximately 0.4% carbon, 5% chromium, 1% molybdenum, and trace amounts of other metal and nonmetal elements adding up to a total of less than 1%, and the remaining proportion to make up 100% is iron.

4. The fuel injection valve of claim 1, wherein the carburization process is a gas carburization process.

5. A method for hardening a fuel injection valve for internal combustion engines, the method comprising the following method steps:

providing a valve body (1) made from a high-alloy hot-work steel, carburization of the valve body in a gas atmosphere that contains a hydrocarbon; and heat-treatment of the valve body at a temperature of 900 to 1000° C., at a pressure of less than 100 Pa.

6. The method of claim 5, wherein the carburization of the valve body takes place at a pressure of less than 100 kPa.

* * * * *

UNITED STATES PATENT AND TRADEMARK OFFICE

CERTIFICATE OF CORRECTION

PATENT NO. : 7,419,553 B2
APPLICATION NO. : 10/398899
DATED : September 2, 2008
INVENTOR(S) : Dieter Liedtke et al.

It is certified that error appears in the above-identified patent and that said Letters Patent is hereby corrected as shown below:

Title page,

Item (30) should read as follows:

(30) Foreign Application Priority Data

Aug. 11, 2001 (DE) ..... 1 01 39 620

Signed and Sealed this

Eleventh Day of November, 2008

JON W. DUDAS
*Director of the United States Patent and Trademark Office*